US006007914A

United States Patent [19]

Joseph et al.

[11] Patent Number: 6,007,914

[45] Date of Patent: Dec. 28, 1999

[54] FIBERS OF POLYDIORGANOSILOXANE POLYUREA COPOLYMERS

[75] Inventors: Eugene G. Joseph, Arden Hills; Ashish K. Khandpur, Roseville; Audrey A. Sherman, St. Paul; Mieczyslaw H. Mazurek, Roseville, all of Minn.; Walter R. Romanko, Austin, Tex.

[73] Assignee: 3M Innovative Properties Company, St. Paul, Minn.

[21] Appl. No.: 08/980,925

[22] Filed: Dec. 1, 1997

[51] Int. Cl.[6] ..... B32B 9/00

[52] U.S. Cl. ..... 428/391; 428/383; 442/71; 442/157; 442/170; 442/394

[58] Field of Search ..... 428/383, 391; 442/170, 157, 71, 394

[56] References Cited

U.S. PATENT DOCUMENTS

| | | | |
|---|---|---|---|
| 2,676,182 | 4/1954 | Daudt et al. . | |
| 2,736,721 | 2/1956 | Dexter . | |
| 3,338,992 | 8/1967 | Kinney . | |
| 3,480,502 | 11/1969 | Chisholm et al. . | |
| 3,487,505 | 1/1970 | Schrenk . | |
| 3,502,763 | 3/1970 | Hartmann | 264/210 |
| 3,627,851 | 12/1971 | Brady | 260/825 |
| 3,692,618 | 9/1972 | Dorschner et al. | 161/72 |
| 3,772,247 | 11/1973 | Flannigan et al. | 260/46.5 |
| 3,890,269 | 6/1975 | Martin | 260/46.5 |
| 3,971,373 | 7/1976 | Braun | 128/146.2 |
| 4,405,297 | 9/1983 | Appel et al. | 425/72 |
| 4,661,577 | 4/1987 | Jo Lane et al. | 528/10 |
| 4,663,220 | 5/1987 | Wisneski et al. | 428/221 |
| 4,707,531 | 11/1987 | Shirahata | 528/12 |
| 4,774,310 | 9/1988 | Butler | 528/23 |
| 4,789,699 | 12/1988 | Kieffer et al. | 524/271 |
| 4,910,064 | 3/1990 | Sabee | 428/113 |
| 4,935,484 | 6/1990 | Wolfgruber et al. | 528/34 |
| 5,026,890 | 6/1991 | Webb et al. | 556/408 |
| 5,028,679 | 7/1991 | Terae et al. | 528/12 |
| 5,110,890 | 5/1992 | Butler | 528/12 |
| 5,118,775 | 6/1992 | Inomata et al. | 528/12 |
| 5,176,952 | 1/1993 | Joseph et al. | 428/284 |
| 5,214,119 | 5/1993 | Leir et al. | 528/28 |
| 5,232,770 | 8/1993 | Joseph | 428/284 |
| 5,236,997 | 8/1993 | Fujiki | 524/731 |
| 5,238,733 | 8/1993 | Joseph et al. | 428/284 |
| 5,248,455 | 9/1993 | Joseph et al. | 264/6 |
| 5,248,739 | 9/1993 | Schmidt et al. | 525/477 |
| 5,258,220 | 11/1993 | Joseph | 428/284 |
| 5,262,558 | 11/1993 | Kobayashi et al. | 556/453 |
| 5,272,023 | 12/1993 | Yamamoto et al. | 428/198 |
| 5,276,122 | 1/1994 | Aoki et al. | 528/14 |
| 5,290,615 | 3/1994 | Tushaus et al. | 428/40 |
| 5,302,447 | 4/1994 | Ogata et al. | 428/288 |
| 5,302,626 | 4/1994 | Nishio et al. | 428/224 |
| 5,302,685 | 4/1994 | Tsumura et al. | 528/33 |
| 5,316,836 | 5/1994 | Heindel et al. | 428/284 |
| 5,319,040 | 6/1994 | Wengrovius et al. | 525/478 |
| 5,324,580 | 6/1994 | Allan et al. | 428/284 |
| 5,461,134 | 10/1995 | Leir et al. | 528/14 |
| 5,462,538 | 10/1995 | Korpman | 604/358 |
| 5,512,650 | 4/1996 | Leir et al. | 528/14 |
| 5,670,598 | 9/1997 | Leir et al. | 528/28 |
| 5,681,305 | 10/1997 | Korpman | 604/390 |

FOREIGN PATENT DOCUMENTS

| | | |
|---|---|---|
| 0 332 719 A1 | 9/1989 | European Pat. Off. . |
| 0 658 351 A1 | 12/1994 | European Pat. Off. . |
| 2-18482 | 7/1988 | Japan . |
| 6-108018 | 4/1994 | Japan . |
| 6-89304 | 11/1994 | Japan . |
| 7-109443 | 4/1995 | Japan . |
| WO 96/16625 | 6/1996 | WIPO . |
| WO 96/23915 | 8/1996 | WIPO . |
| WO 96/34028 | 10/1996 | WIPO . |
| WO 96/34029 | 10/1996 | WIPO . |
| WO 96/34030 | 10/1996 | WIPO . |
| WO 96/35458 | 11/1996 | WIPO . |

OTHER PUBLICATIONS

Tyagi et al., "Segmented Organosiloxane Copolymers: 2. Thermal and Mechanical Properties of Siloxane urea Copolymers", *Polymer,* vol. 25, Dec. 1984.

*Encyclopedia of Polymer Science and Engineering,* vol. 15, John Wiley & Sons, New York (1989), pp. 265–270.

*Industrial Engineering Chemistry,* "Superfine Organic Fibers", Report No. 4364 of the Naval Research Laboratories, published May 25, 1954.

Smorada, Ronald L., "Spunbonded Technology: An Historical Perspective", *Inda Jnr,* vol. 3, No. 4, (undated).

*Primary Examiner*—Melvyn I. Marquis

*Attorney, Agent, or Firm*—Gary L. Griswold; Robert W. Sprague; William J. Bond

[57] ABSTRACT

The present invention provides fibers and products produced therefrom, including nonwoven webs and adhesive articles. The fibers, which can be multilayer fibers, include a polydiorganosiloxane polyurea copolymer.

56 Claims, 1 Drawing Sheet

FIBERS OF POLYDIORGANOSILOXANE POLYUREA COPOLYMERS

FIELD OF THE INVENTION

The present invention is directed to fibers, particularly microfibers, of polydiorganosiloxane polyurea copolymers, as well as products produced therefrom.

BACKGROUND OF THE INVENTION

Fibers having a diameter of no greater than about 100 microns ($\mu$m), and particularly microfibers having a diameter of no greater than about 50 $\mu$m, have been developed for a variety of uses and with a variety of properties. They are typically used in the form of nonwoven webs that can be used in the manufacture of face masks and respirators, air filters, vacuum bags, oil and chemical spill sorbents, thermal insulation, first aid dressings, medical wraps, surgical drapes, disposable diapers, wipe materials, and the like. The fibers can be made by a variety of melt processes, including a spunbond process and a melt-blown process.

In a spunbond process, fibers are extruded from a polymer melt stream through multiple banks of spinnerets onto a rapidly moving, porous belt, for example, forming an unbonded web. This unbonded web is then passed through a bonder, typically a thermal bonder, which bonds some of the fibers to neighboring fibers, thereby providing integrity to the web. In a melt-blown process, fibers are extruded from a polymer melt stream through fine orifices using high air velocity attenuation onto a rotating drum, for example, forming an autogenously bonded web. In contrast to a spunbond process, no further processing is necessary.

Fibers formed from either melt process can contain one or more polymers, and can be of one or more layers, which allows for tailoring the properties of the fibers and products produced therefrom. For example, melt-blown multilayer microfibers can be produced by first feeding one or more polymer melt streams to a feedblock, optionally separating at least one of the polymer melt streams into at least two distinct streams, and recombining the melt streams, into a single polymer melt stream of longitudinally distinct layers, which can be of at least two different polymeric materials arranged in an alternating manner. The combined melt stream is then extruded through fine orifices and formed into a highly conformable web of melt-blown microfibers.

Thermoplastic materials, such as thermoplastic elastomers, can be used in the melt processing of fibers, particularly microfibers. Examples of such thermoplastic materials include polyurethanes, polyetheresters, polyamides, polyarene polydiene block copolymers such as those sold under the trade designation KRATON, and blends thereof. It is known that such thermoplastic materials can be either adhesive in nature or can be blended with tackifying resins to increase the adhesiveness of the materials. For example, webs of microfibers made using a melt-blown process from pressure-sensitive adhesives comprising block copolymers, such as styrene/isoprene/styrene block copolymers available under the trade designation KRATON, are disclosed in International Publication No. WO 96/16625 (The Procter & Gamble Company) and U.S. Pat. No. 5,462,538 (Korpman). Also, webs of multilayer microfibers made using a melt-blown process from tackified elastomeric materials, such as KRATON block copolymers, are disclosed in U.S. Pat. Nos. 5,176,952 (Joseph et al.), 5,238,733 (Joseph et al.), and 5,258,220 (Joseph).

Thus, nonwoven webs are known that are formed from melt-processed fibers having a variety of properties, including adhesive and nonadhesive properties. Not all polymeric materials, however, are suitable for use in melt processes used to make such fibers. This is particularly true for materials that are pressure-sensitive adhesives, typically because the extreme conditions used in melt processes can cause significant breakdown of molecular weights of the polymers resulting in low cohesive strength of the fiber. Thus, there is still a need for nonwoven webs of fibers having a variety of properties, particularly pressure-sensitive adhesive properties.

SUMMARY OF THE INVENTION

The present invention provides fibers and products produced therefrom, including nonwoven webs and adhesive articles. The fibers, which can be multilayer fibers, include a polydiorganosiloxane polyurea copolymer as a structural component of the fibers. By this it is meant that the polydiorganosiloxane polyurea copolymer is an integral component of the fiber itself and not simply a post-fiber formation coating.

The fibers can also include a secondary melt processable polymer or copolymer, such as a polyolefin, a polystyrene, a polyurethane, a polyester, a polyamide, a styrenic block copolymer, an epoxy, a vinyl acetate, and mixtures thereof. The secondary melt processable polymer or copolymer can be mixed (e.g., blended) with the polydiorganosiloxane polyurea copolymer or in a separate layer. Either the polydiorganosiloxane polyurea copolymer, the secondary melt processable polymer or copolymer, or both can be tackified.

The secondary melt processable polymer or copolymer can be mixed (e.g., blended) with the polydiorganosiloxane polyurea copolymer or in a separate layer. For example, the fibers of the present invention can include at least one layer (a first layer) of a polydiorganosiloxane polyurea copolymer. Other layers can include different polydiorganosiloxane polyurea copolymers or secondary melt processable polymers or copolymers. For example, the fibers of the present invention can include at least one layer (a second layer) of a secondary melt processable polymer or copolymer.

The polydiorganosiloxane polyurea copolymer is preferably the reaction product of at least one polyisocyanate with at least one polyamine; wherein the polyamine comprises at least one polydiorganosiloxane diamine, or a mixture of at least one polydiorganosiloxane diamine and at least one organic amine. Preferably, the mole ratio of isocyanate to amine is in a range of about 0.9:1 to about 1.3:1.

The polydiorganosiloxane polyurea copolymer can be represented by the repeating unit:

(I)

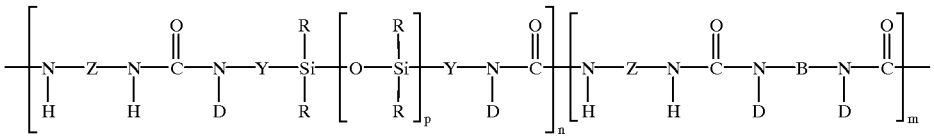

wherein:

each R is a moiety that independently is:

an alkyl moiety having 1 to 12 carbon atoms optionally substituted with trifluoroalkyl or vinyl groups;

a vinyl moiety or higher alkenyl moiety represented by the formula $—R^2(CH_2)_aCH{=}CH_2$ wherein $R^2$ is $—(CH_2)_b—$ or $—(CH_2)_cCH{=}CH—$ and a is 1, 2, or 3, is 0, 3, or 6, and c is 3, 4, or 5;

a cycloalkyl moiety having 6 to 12 carbon atoms optionally substituted with alkyl, fluoroalkyl, and vinyl groups;

an aryl moiety having 6 to 20 carbon atoms optionally substituted with alkyl, cycloalkyl, fluoroalkyl and vinyl groups;

a perfluoroalkyl group;

a fluorine-containing group; or a perfluoroether-containing group;

each Z is a polyvalent moiety that is an arylene moiety or an aralkylene moiety having 6 to 20 carbon atoms, or an alkylene or cycloalkylene moiety having 6 to 20 carbon atoms;

each Y is a polyvalent moiety that independently is an alkylene moiety having 1 to 10 carbon atoms, or an aralkylene moiety or an arylene moiety having 6 to 20 carbon atoms;

each D is independently selected from the group of hydrogen, an alkyl moiety of 1 to 10 carbon atoms, phenyl, and a moiety that completes a ring structure including B or Y to form a heterocycle;

B is a polyvalent moiety selected from the group of alkylene, aralkylene, cycloalkylene, phenylene, polyalkylene oxide, copolymers and mixtures thereof;

m is a number that is 0 to about 1000;

n is a number that is equal to or greater than 1 (preferably, n is greater than 8); and p is a number that is about 5 or larger.

A lower molecular weight polydiorganosiloxane polyurea copolymer is a polydiorganosiloxane oligourea segmented copolymer represented by Formula II:

(II)

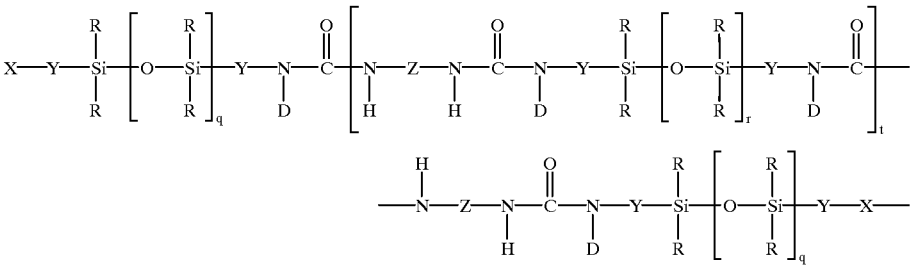

wherein:

each R is a moiety that independently is:

an alkyl moiety having 1 to 12 carbon atoms optionally substituted with trifluoroalkyl or vinyl groups;

a vinyl moiety or higher alkenyl moiety represented by the formula $—R^2(CH_2)_aCH{=}CH_2$ wherein $R^2$ is $—(CH_2)_b—$ or $—(CH_2)_cCH{=}CH—$ and a is 1, 2, or 3, b is 0, 3, or 6, and c is 3, 4, or 5;

a cycloalkyl moiety having 6 to 12 carbon atoms optionally substituted with alkyl, fluoroalkyl, and vinyl groups;

an aryl moiety having 6 to 20 carbon atoms optionally substituted with alkyl, cycloalkyl, fluoroalkyl and vinyl groups;

a perfluoroalkyl group;

a fluorine-containing group; or a perfluoroether-containing group;

each Z is a polyvalent moiety that is an arylene moiety or an aralkylene moiety having 6 to 20 carbon atoms, or an alkylene or cycloalkylene moiety having 6 to 20 carbon atoms;

each Y is a polyvalent moiety that independently is an alkylene moiety having 1 to 10 carbon atoms, or an aralkylene moiety or an arylene moiety having 6 to 20 carbon atoms;

each D is independently selected from the group of hydrogen, an alkyl moiety of 1 to 10 carbon atoms, phenyl, and a moiety that completes a ring structure including Y to form a heterocycle;

each X is a monovalent moiety which is not reactive under moisture curing or free radical curing conditions and which independently is an alkyl moiety having about 1 to 12 carbon atoms;

q is a number that is about 5 to about 2000;

r is a number that is about 1 to about 2000; and t is a number that is up to about 8.

The present invention also provides a nonwoven web that includes the fibers described above. The nonwoven web can be in the form of a commingled web of various types of fibers. These various types of fibers may be in the form of separate layers within the nonwoven web, or they may be intimately mixed such that the web has a substantially uniform cross-section. In addition to the fibers that include a polydiorganosiloxane polyurea copolymer, the nonwoven web can further include fibers selected from the group of thermoplastic fibers, carbon fibers, glass fibers, mineral fibers, organic binder fibers, and mixtures thereof The nonwoven web can also include particulate material.

The present invention also provides an adhesive article. The adhesive article, which may be in the form of a tape, includes a backing and a layer of a nonwoven web laminated to at least one major surface of the backing. The nonwoven web includes polydiorganosiloxane polyurea fibers. Significantly, the nonwoven web of the polydiorganosiloxane polyurea fibers may form a pressure-sensitive adhesive layer or a low adhesion backsize layer, depending on the composition of the fibers.

DETAILED DESCRIPTION OF PREFERRED EMBODIMENTS

Figure 1:
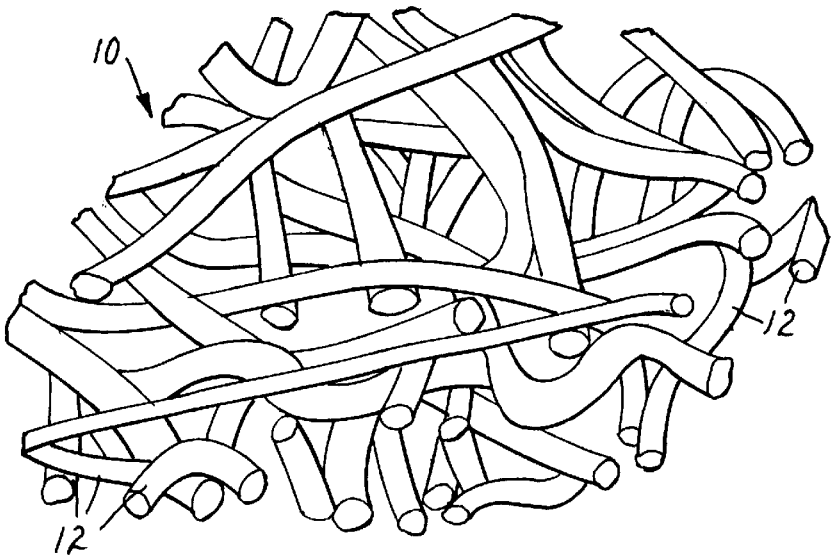
FIG. 1 is a perspective view of a nonwoven web of the present invention made from multilayer fibers.

The present invention is directed to coherent fibers comprising a polydiorganosiloxane polyurea copolymer. Such siloxane-based fibers typically have a diameter of no greater than about 100 $\mu$m, and are useful in making coherent nonwoven webs that can be used in making a wide variety of products. Preferably, such fibers have a diameter of no greater than about 50 $\mu$m, and often, no greater than about 25 $\mu$m. Fibers of no greater than about 50 $\mu$m are often referred to as "microfibers."

Polydiorganosiloxane polyurea copolymers are advantageous because they can possess one or more of the following properties: resistance to ultraviolet light; good thermal and oxidative stability; good permeability to many gases; low surface energy; low index of refraction; good hydrophobicity; good dielectric properties; good biocompatibility; good adhesive properties (either at room temperature or in the melt state). Fibers made of such polymers, and nonwoven webs of such fibers, are particularly desirable because they provide a material with a high surface area. The nonwoven webs also have high porosity. Nonwoven webs, preferably, nonwoven adhesive webs, and more preferably, nonwoven pressure-sensitive adhesive webs, having a high surface area and porosity are desirable because they possess the characteristics of breathability, moisture transmission, conformability, and good adhesion to irregular surfaces.

The nonwoven webs of the present invention may have pressure-sensitive adhesive (PSA) properties at room temperature, they may have hot melt adhesive properties, or they may have release properties. If the nonwoven webs have pressure-sensitive adhesive properties, the PSA properties may be the result of the self-tackiness of the polymeric composition of the fibers, or, more typically, as a result of the incorporation of a tackifier into the polymeric composition of the fibers. Thus, certain nonwoven webs of the present invention may have good adhesive properties (e.g., a peel strength to glass of at least about 200 grams per 2.54 centimeter width as measured by ASTM D3330-87). Alternatively, certain nonwoven webs of the present invention may have good release properties against pressure sensitive adhesives.

Suitable polydiorganosiloxane polyurea copolymers are those that are capable of being extruded and forming fibers in a melt process, such as a spunbond process or a melt-blown process, without substantial degradation or gelling. That is, suitable polymers have a relatively low viscosity in the melt such that they can be readily extruded. Such polymers preferably have an apparent viscosity in the melt (i.e., at melt blowing conditions) in a range of about 150 poise to about 800 poise as measured by either capillary rheometry or cone and plate rheometry. Preferred polydiorganosiloxane polyurea copolymers are those that are capable of forming a melt stream in a melt blown process that maintains its integrity with few, if any, breaks in the melt stream. That is, preferred polydiorganosiloxane polyurea copolymers have an extensional viscosity that allows them to be drawn effectively into fibers.

Fibers formed from suitable polydiorganosiloxane polyurea copolymers have sufficient cohesive strength and integrity at their use temperature such that a web formed therefrom maintains its fibrous structure. Sufficient cohesiveness and integrity typically depends on the overall molecular weight of the polydiorganosiloxane polymer, and the concentration and nature of the urea linkages. Fibers comprising suitable polydiorganosiloxane polyurea copolymers also have relatively low or no cold flow, and display good aging properties, such that the fibers maintain their shape and desired properties (e.g., adhesive properties) over an extended period of time under ambient conditions.

To tailor the properties of the fibers, one or more polydiorganosiloxane polyurea copolymers or other nonpolydiorganosiloxane polyurea copolymers can be used to make conjugate fibers of the present invention. These different polymers can be in the form of polymeric mixtures (preferably, compatible polymeric blends), two or more layered fibers, sheath-core fiber arrangements, or in "island in the sea" type fiber structures. Preferably, with multilayered conjugate fibers, the individual components will be present substantially continuously along the fiber length in discrete zones, which zones preferably extend along the entire length of the fibers.

The non-polydiorganosiloxane polyurea polymers are melt processable (typically, thermoplastic) and may or may not have elastomeric properties. They also may or may not have adhesive properties. Such polymers (referred to herein as secondary melt processable polymers or copolymers) have relatively low shear viscosity in the melt such that they can be readily extruded, and drawn effectively to form fibers, as described above with respect to the polydiorganosiloxane polyurea copolymers. In the polymeric mixtures (e.g., polymeric blends), the non-polydiorganosiloxane polyurea copolymers may or may not be compatible with the polydiorganosiloxane polyurea copolymers, as long as the overall mixture is a fiber forming composition. Preferably, however, the rheological behavior in the melt of the polymers in a polymeric mixture (preferably, polymeric blend) are similar.

Figure 2:
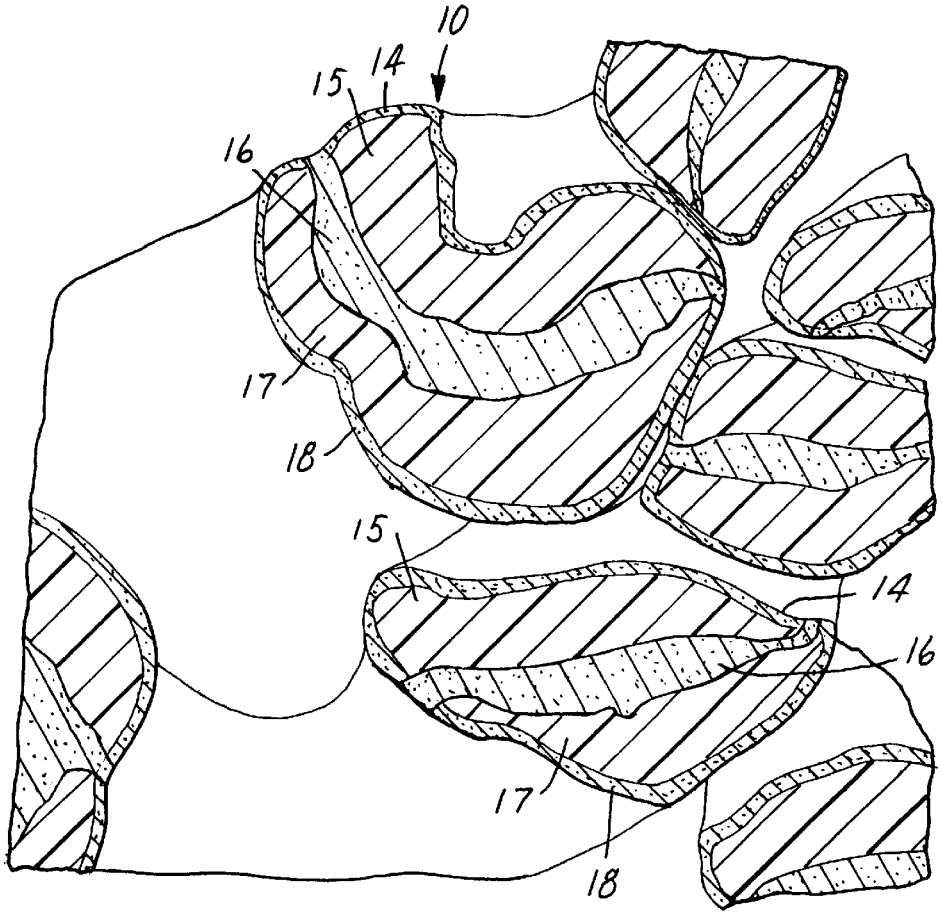
FIG. 2 is a cross-sectional view of the nonwoven web of FIG. 1 at higher magnification showing a five layer construction of the fibers.

FIG. 1 is an illustration of a nonwoven web 10 prepared from multilayered fibers 12 according to the present invention. FIG. 2 is a cross-sectional view of the nonwoven web 10 of FIG. 1 at higher magnification showing a five layer construction of the fibers 12. The multilayered fibers 12 each have five discrete layers of organic polymeric material. There are three layers 14, 16, 18 of one type of organic polymeric material (e.g., a polydiorganosiloxane polyurea), and two layers 15,17 of a second type of organic polymeric material (e.g., a blend of a polydiorganosiloxane polyurea and a KRATON block copolymer). It is significant to note, that the surface of the fibers have exposed edges of the layers of both materials. Thus, the fibers, and hence, the nonwoven webs, of the present invention, can demonstrate properties associated with both types of materials simultaneously. Although FIG. 1 illustrates a fiber having five layers of material, the fibers of the present invention can include fewer or many more layers, e.g., hundreds of layers. Thus, the coherent fibers of the present invention can include, for example, one type of polydiorganosiloxane polyurea in one layer, two or more different polydiorganosiloxane polyureas in two or more layers, or a polydiorganosiloxane polyurea layered with a secondary melt processable polymer or copolymer in two or more layers. Each of the layers can be a mixture of different polydiorganosiloxane polyureas and/or secondary melt processable polymers or copolymers.

Preferred Polydiorganosiloxane Polyurea Copolymers

Herein, "copolymer" refers to polymers containing two or more different monomers, including terpolymers, tetrapolymers, etc. Preferred polydiorganosiloxane polyurea copolymers suitable for use in the preparation of fibers, preferably microfibers, according to the present invention are the reaction products of at least one polyamine, wherein the polyamine comprises at least one polydiorganosiloxane polyamine (preferably, diamine), or a mixture of at least one polydiorganosiloxane polyamine (preferably, diamine) and at least one organic amine, with at least one polyisocyanate, wherein the mole ratio of isocyanate to amine is preferably in a range of about 0.9:1 to about 1.3:1. That is, preferred polydiorganosiloxane polyurea copolymers suitable for use in the preparation of fibers according to the present invention have soft polydiorganosiloxane units, hard polyisocyanate residue units, and optionally, soft and/or hard organic polyamine residue units and terminal groups. The hard polyisocyanate residue and the hard polyamine residue comprise less than 50% by weight of the polydiorganosiloxane polyurea copolymer. The polyisocyanate residue is the polyisocyanate minus the —NCO groups and the polyamine residue is the polyamine minus the —$NH_2$ groups. The polyisocyanate residue is connected to the polyamine residue by the urea linkages. The terminal groups may be nonfunctional groups or functional groups depending on the purpose of the polydiorganosiloxane polyurea copolymers. Examples of such segmented copolymers are disclosed in International Publication Nos. WO 96/34029 and WO 96/35458, both to the 3M Company, St. Paul, Minn., and U.S. patent application Ser. No. 08/735,836, filed Oct. 23, 1996. As used herein, the term "polydiorganosiloxane polyurea" encompasses materials having the repeating unit of Formula I and low molecular weight oligomeric materials having the structure of Formula II. Such compounds are suitable for use in the present invention if they can be melt processed.

Preferably, the polydiorganosiloxane polyurea copolymers used in preparing the fibers of the present invention can be represented by the repeating unit:

where:

each R is a moiety that independently is an alkyl moiety preferably having 1 to 12 carbon atoms and may be substituted with, for example, trifluoroalkyl or vinyl groups, a vinyl moiety or higher alkenyl moiety preferably represented by the formula —$R^2(CH_2)_aCH{=}CH_2$ wherein $R^2$ is —$(CH_2)_b$— or —$(CH_2)_cCH{=}CH$— and a is 1, 2, or 3; b is 0, 3, or 6; and c is 3, 4, or 5, a cycloalkyl moiety having 6 to 12 carbon atoms and may be substituted with alkyl, fluoroalkyl, and vinyl groups, or an aryl moiety preferably having 6 to 20 carbon atoms and may be substituted with, for example, alkyl, cycloalkyl, fluoroalkyl and vinyl groups or R is a perfluoroalkyl group as described in U.S. Pat. No. 5,028,679 (Terae et al.), a fluorine-containing group, as described in U.S. Pat. No. 5,236,997 (Fijiki), or a perfluoroether-containing group, as described in U.S. Pat. Nos. 4,900,474 (Terae et al.) and 5,118,775 (Inomata et al.); preferably at least 50% of the R moieties are methyl moieties with the balance being monovalent alkyl or substituted alkyl moieties having 1 to 12 carbon atoms, alkenylene moieties, phenyl moieties, or substituted phenyl moieties;

each Z is a polyvalent moiety that is an arylene moiety or an aralkylene moiety preferably having 6 to 20 carbon atoms, an alkylene or cycloalkylene moiety preferably having 6 to 20 carbon atoms, preferably Z is 2,6-tolylene, 4,4'-methylenediphenylene, 3,3'-dimethoxy-4,4'-biphenylene, tetramethyl-m-xylylene, 4,4'-methylenedicyclohexylene, 3,5,5-trimethyl-3-methylenecyclohexylene, 1,6-hexamethylene, 1,4-cyclohexylene, 2,2,4-trimethylhexylene and mixtures thereof;

each Y is a polyvalent moiety that independently is an alkylene moiety preferably having 1 to 10 carbon atoms, an aralkylene moiety or an arylene moiety preferably having 6 to 20 carbon atoms;

each D is independently selected from the group consisting of hydrogen, an alkyl moiety of 1 to 10 carbon atoms, phenyl, and a moiety that completes a ring structure including B or Y to form a heterocycle;

B is a polyvalent moiety selected from the group consisting of alkylene, aralkylene, cycloalkylene, phenylene, polyalkylene oxide, including for example, polyethylene oxide, polypropylene oxide, polytetramethylene oxide, and copolymers and mixtures thereof;

m is a number that is 0 to about 1000;

n is a number that is equal to or greater than 1 (preferably, n is greater than 8); and p is a number that is about 5 or larger, preferably, about 15 to about 2000, more preferably, about 30 to about 1500.

In the use of polyisocyanates when Z is a moiety having a functionality greater than 2 and/or polyamines when B is (I)

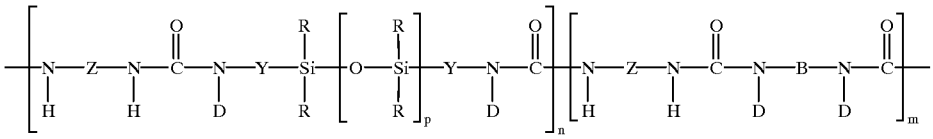

a moiety having a functionality greater than 2, the structure of Formula I will be modified to reflect branching at the polymer backbone. In the use of endcapping agents, the structure of Formula I will be modified to reflect termination of the polydiorganosiloxane polyurea chain.

Lower molecular weight polydiorganosiloxane oligourea segmented copolymers provide a means of varying the modulus of elasticity of compositions containing this component. They can serve to either increase or decrease the modulus of the resultant composition, depending upon the particular polydiorganosiloxane mono- and di-amines employed in the preparation of the polydiorganosiloxane oligourea segmented copolymer. Examples of such segmented copolymers are disclosed in International Publication Nos. WO 96/34029 and WO 96/34030, both to the 3M Company.

The lower molecular weight polydiorganosiloxane oligourea segmented copolymers can be represented by Formula II, as follows:

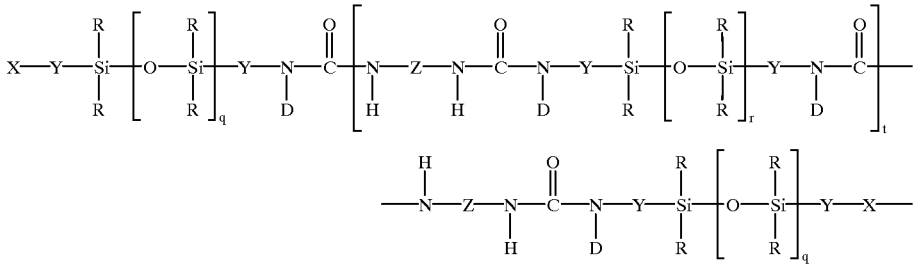

(II)

where: Z, Y, R, and D are previously described;

each X is a monovalent moiety which is not reactive under moisture curing or free radical curing conditions and which independently is an alkyl moiety preferably having about 1 to about 12 carbon atoms and which may be substituted with, for example, trifluoroalkyl or vinyl groups or an aryl moiety preferably having about 6 to about 20 carbon atoms and which may be substituted with, for example, alkyl, cycloalkyl, fluoroalkyl and vinyl groups;

q is a number of about 5 to about 2000 or larger;

r is a number of about 1 to about 2000 or larger; and t is a number up to about 8.

These lower molecular weight polydiorganosiloxane oligourea copolymers can be used alone or in combination with the higher molecular weight polydiorganosiloxane polyurea copolymers (e.g., wherein, n in Formula I is greater than 8). For example, higher molecular weight polydiorganosiloxane polyurea copolymers can be layered with these lower molecular weight polydiorganosiloxane oligourea segmented copolymers. Alternatively, the higher molecular weight polydiorganosiloxane polyurea copolymers can optionally be blended with a lower molecular weight polydiorganosiloxane oligourea segmented copolymer which, when present, is preferably present in an amount of from about 5 parts to about 50 parts per 100 total parts of the composition. If the lower molecular weight polydiorganosiloxane oligourea copolymers are used alone, they may need to be cured (e.g., UV cured) substantially immediately upon forming the fibers (e.g., substantially immediately upon forming the web and before the web is rolled for storage) to maintain sufficient fiber integrity.

Reactive Components of the Polydiorganosiloxane Polyurea Copolymers

Different polyisocyanates in the reaction will modify the properties of the polydiorganosiloxane polyurea copolymers in varying ways. For example, if a polycarbodiimide-modified diphenylmethane diisocyanate, such as ISONATE 143L, available from Dow Chemical Co., Midland, Mich., is used, the resulting polydiorganosiloxane polyurea copolymer has enhanced solvent resistance when compared with copolymers prepared with other diisocyanates. If tetramethyl-m-xylylene diisocyanate is used, the resulting segmented copolymer has a very low melt viscosity that makes it particularly useful for melt processing.

Diisocyanates useful in the process of the present invention can be represented by the formula $$OCN—Z—NCO \quad (III)$$

Any diisocyanate that can react with a polyamine, and in particular with polydiorganosiloxane diamine of Formula IV, below, can be used in the present invention. Examples of such diisocyanates include, but are not limited to, aromatic diisocyanates, such as 2,6-toluene diisocyanate, 2,5-toluene diisocyanate, 2,4-toluene diisocyanate, m-phenylene diisocyanate, p-phenylene diisocyanate, methylene bis(o-chlorophenyl diisocyanate), methylenediphenylene-4,4'-diisocyanate, polycarbodiimide-modified methylenediphenylene diisocyanate, (4,4'-diisocyanato-3,3',5,5'-tetraethyl) diphenylmethane, 4,4'-diisocyanato-3,3'-dimethoxybiphenyl (o-dianisidine diisocyanate), 5-chloro-2,4-toluene diisocyanate, 1-chloromethyl-2,4-diisocyanato benzene, aromatic-aliphatic diisocyanates such as m-xylylene diisocyanate, tetramethyl-m-xylylene diisocyanate, aliphatic diisocyanates, such as 1,4-diisocyanatobutane, 1,6-diisocyanatohexane, 1,12-diisocyanatododecane, 2-methyl-1,5-diisocyanatopentane, and cycloaliphatic diisocyanates such as methylenedicyclohexylene-4,4'-diisocyanate, 3-isocyanatomethyl-3,5,5-trimethylcyclohexyl isocyanate (isophorone diisocyanate), 2,2,4-trimethylhexyl diisocyanate, and cyclohexylene-1,4-diisocyanate and mixtures thereof.

Preferred diisocyanates include 2,6-toluene diisocyanate, methylenediphenylene-4,4'-diisocyanate, polycarbodiimide-modified methylenediphenyl diisocyanate, 4,4'-diisocyanato-3,3'-dimethoxybiphenyl(o-dianisidine diisocyanate), tetramethyl-m-xylylene diisocyanate, methylenedicyclohexylene-4,4'-diisocyanate, 3-isocyanatomethyl-3,5,5-trimethylcyclohexyl isocyanate (isophorone diisocyanate), 1,6-diisocyanatohexane, 2,2,4-trimethylhexyl diisocyanate, and cyclohexylene-1,4-diisocyanate.

Any triisocyanate that can react with a polyamine, and in particular with polydiorganosiloxane diamine of Formula IV, below, can be used in the present invention. Examples of such triisocyanates include, but are not limited to, polyfunctional isocyanates, such as those produced from biurets, isocyanurates, adducts and the like. Some commercially available polyisocyanates include portions of the DESMODUR and MONDUR series from Miles Laboratory, Pittsburg, Pa., and the PAPI series of Dow Plastics, Midland, Mich. Preferred triisocyanates include DESMODUR N-3300 and MONDUR 489.

Polydiorganosiloxane polyamines useful in the process of the present invention are preferably diamines, which can be represented by the formula (IV)

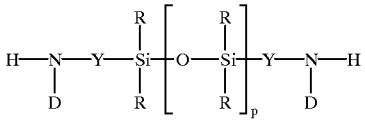

wherein each of R, Y, D, and p are defined as above. Generally, the number average molecular weight of the polydiorganosiloxane polyamines useful in the present invention are greater than about 700.

Preferred polydiorganosiloxane diamines (also referred to as silicone diamines) useful in the present invention are any which fall within Formula IV above and including those having molecular weights in the range of about 700 to 150,000. Polydiorganosiloxane diamines are disclosed, for example, in U.S. Pat. Nos. 3,890,269 (Martin), 4,661,577 (JoLane et al.), 5,026,890 (Webb et al.), 5,214,119 (Leir et al.), 5,276,122 (Aoki et al.), 5,461,134 (Leir et al.), and 5,512,650 (Leir et al.).

Polydiorganosiloxane polyamines are commercially available from, for example, Shin Etsu Silicones of America, Inc., Torrance, Calif., and Hüls America, Inc., Pitscataway, N.J. Preferred are substantially pure polydiorganosiloxane diamines prepared as disclosed in U.S. Pat. No. 5,214,119 (Leir et al.). The polydiorganosiloxane diamines having such high purity are prepared from the reaction of cyclic organosilanes and bis(aminoalkyl)disiloxanes utilizing an anhydrous amino alkyl functional silanolate catalyst such as tetramethylammonium-3-aminopropyldimethyl silanolate, preferably in an amount less than 0.15 weight percent based on the weight of the total amount of cyclic organosiloxane with the reaction run in two stages. Particularly preferred polydiorganosiloxane diamines are prepared using cesium and rubidium catalysts and are disclosed in U.S. Pat. No. 5,512,650 (Leir et al.).

Examples of polydiorganosiloxane polyamines useful in the present invention include, but are not limited to, polydimethylsiloxane diamine, polydiphenylsiloxane diamine, polytrifluoropropylmethylsiloxane diamine, polyphenylmethylsiloxane diamine, polydiethyl siloxane diamine, polydivinylsiloxane diamine, polyvinylmethylsiloxane diamine, poly(5-hexenyl)methylsiloxane diamine, and copolymers and mixtures thereof.

The polydiorganosiloxane polyamine component employed to prepare polydiorganosiloxane polyurea segmented copolymers of this invention provides a means of adjusting the modulus of elasticity of the resultant copolymer. In general, high molecular weight polydiorganosiloxane polyamines provide copolymers of lower modulus, whereas low molecular polydiorganosiloxane polyamines provide polydiorganosiloxane polyurea segmented copolymers of higher modulus.

When polydiorganosiloxane polyurea segmented copolymer compositions contain an optional organic polyamine, this optional component provides yet another means of modifying the modulus of elasticity of copolymers of this invention. The concentration of organic polyamine as well as the type and molecular weight of the organic polyamine determine how it influences the modulus of polydiorganosiloxane polyurea segmented copolymers containing this component.

Examples of organic polyamines useful in the present invention include but are not limited to polyoxyalkylene diamine, such as D-230, D-400, D-2000, D-4000, DU-700, ED-2001 and EDR-148, all available from Huntsman Chemical Corp., Salt Lake City, Utah, polyoxyalkylene triamine, such as T-3000 and T-5000 available from Huntsman, polyalkylenes, diamines such as DYTEK A and DYTEK EP, available from DuPont, Wilmington, Del., and mixtures thereof.

When the reaction of the polyamine and the polyisocyanate is carried out under solventless conditions to prepare the polydiorganosiloxane polyurea segmented copolymer, the relative amounts of amine and isocyanate can be varied over a much broader range than those produced by solvent methods. Molar ratios of isocyanate to amine continuously provided to the reactor are preferably from about 0.9:1 to 1.3:1, more preferably 1:1 to 1.2:1.

Once the reaction of the polyisocyanate with the polyamine has occurred, active hydrogens in the urea linkage may still be available for reaction with excess isocyanate. By increasing the ratio of isocyanate to amine, the formation of biuret moieties may be facilitated, especially at higher temperatures, resulting in branched or crosslinked polymer. Low to moderate amounts of biuret formation can be advantageous to shear properties and solvent resistance.

The nature of the isocyanate residue in the polydiorganosiloxane polyurea copolymer influences stiffiess and flow properties, and also affects the properties of the mixtures. Isocyanate residues resulting from diisocyanates that form crystallizable ureas, such as tetramethyl-m-xylylene diisocyanate, 1,12-dodecane diisocyanate, dianisidine diisocyanate, provide mixtures that can be stiffer, if sufficient polydiorganosiloxane polyurea copolymer is used, than those prepared from methylenedicyclohexylene-4,4'-diisocyanate, 3-isocyanatomethyl-3,5,5-trimethylcyclohexyl isocyanate, and m-xylylene diisocyanate.

Optional endcapping agents may be incorporated, as needed, to introduce nonfunctional moisture curable or free radically curable moieties into the polydiorganosiloxane polyurea copolymer. The agents are reactive with either amines or isocyanates.

Crosslinking agents, if desired may be used, for example silane agents may be used to crosslink moisture curable polydiorganosiloxane polyurea copolymers or photoinitiators can be used for free-radically curable polydiorganosiloxanes urea copolymer. When used, the amounts of such components are those that are suitable for the purpose intended and are typically used at a concentration of from about 0.1% to about 5% by weight of the total polymerizable composition.

Preparation of the Polydiorganosiloxane Polyurea Copolymers

The polydiorganosiloxane polyurea copolymers can be made, stored, and then extruded into the form of fibers. If the preformed polymer does not have pressure-sensitive adhesive properties, it optionally can be coextruded with a tackifier during the fiber-forming melt process. Alternatively, the polymers can be prepared in situ (e.g., in an extruder), with or without pressure-sensitive adhesive properties, and then immediately formed into fibers.

Preferably, the polydiorganosiloxane polyurea copolymers can be made by solvent-based processes known to the art, by a solventless process or by a combination of the two. Solvent-based processes are well known in the art. Examples of solvent-based processes by which the polydiorganosiloxane polyurea copolymer useful in the present invention can be prepared include: Tyagi et al., "Segmented Organosiloxane Copolymers: 2. Thermal and Mechanical Properties of Siloxane urea Copolymers," *Polymer*, Vol. 25, December, 1984 and U.S. Pat. No. 5,214,119 (Leir et al.).

Another particularly useful process for making the polydiorganosiloxane polyurea copolymers is a solventless process. Any reactor is suitable for use when the polydiorganosiloxane polyurea copolymer is made under substantially solventless conditions as long as the reactor can provide intimate mixing of the isocyanate reactant component and the amine reactant component of the reaction. The reaction may be carried out as a batch process using, for example, a flask equipped with a mechanical stirrer, provided the product of the reaction has a sufficiently low viscosity at the processing temperature to permit mixing. In addition, the reaction may be carried out as a continuous process using, for example, a single screw or twin screw extruder. Preferably, the reactor is a wiped surface counter-rotating or co-rotating twin screw extruder. Most preferably, the reactor is a wiped surface extruder having relatively close clearances between the screw flight lands and the barrel, with this value typically lying between about 0.1 mm to about 2 mm. The screws utilized are preferably fully or partially intermeshing or fully or partially wiped in the zones where a substantial portion of the reaction takes place. Total residence time in a vessel to make the polydiorganosiloxane polyurea copolymer typically varies from about 5 seconds to about 20 minutes, more typically, from about 15 seconds to about 8 minutes. The reaction between the isocyanate and amine reactants is fast and can occur at room temperature. Thus, the formation of the polydiorganosiloxane polyurea copolymer can easily take place, for example, in as little as one 5:1 length to diameter unit of a twin screw extruder. Temperatures between 140° C. and 250° C. are generally sufficient to transport the polydiorganosiloxane polyurea copolymer from the vessel.

The ability to eliminate the presence of solvent during the reaction of polyamine and polyisocyanate yields a much more efficient reaction. The average residence time using the process of the present invention is typically 10 to 1000 times shorter than that required in solution polymerization. A small amount of non-reactive solvent can be added, if necessary, for example, from about 0.5% up to about 5% of the total composition, in this process either as a carrier for injecting otherwise solid materials or in order to increase stability of an otherwise low flow rate stream of material into the reaction chamber.

Rates of addition are also important. Because of the rapid reaction which occurs between the polyamine and the polyisocyanate, both reactants are preferably fed into an extruder at unvarying rates, particularly when using higher molecular weight polyamines, i.e., with molecular weights of about 50,000 and higher. Such feeding generally reduces undesirable variability of the final product. One method of ensuring the continuous feeding into the extruder when a very low flow polyisocyanate stream is to allow the polyisocyanate feed line to touch or very nearly touch the passing threads of the screws. Another method would be to utilize a continuous spray injection device which produces a continuous stream of fine droplets of the polyisocyanates into the reactor.

Polydiorganosiloxane polyurea copolymers can be made having higher molecular weights than possible with a solvent process. Polydiorganosiloxane polyurea copolymers made with polydiorganosiloxane polyamines having molecular weights over 20,000 often do not achieve the degree of polymerization in solvent processes that are obtainable in solventless processes.

The lower molecular weight polydiorganosiloxane polyurea segmented oligomer components of Formula II may be made by either a solvent process or a solventless process similar to that used for making polydiorganosiloxane polyurea segmented copolymer except the input materials comprise:

(A) at least one diisocyanate represented by Formula III;

(B) at least one polydiorganosiloxane monoamine represented by Formula V as follows:

(V)

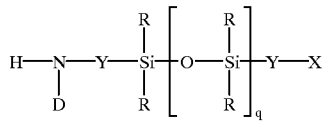

where R, Y, D, X, and q are defined above; and (C) optionally, at least one polydiorganosiloxane diamine represented by Formula IV except that p is an integer greater than 0. In general approximately one mole of (A) is used for every two moles of (B) and approximately an additional mole of (A) is used for each mole of (C) that is used. In the process for making polydiorganosiloxane oligourea segmented copolymers, the polydiorganosiloxane monoamine(s), isocyanate(s), and optionally polydiorganosiloxane diamine(s) are mixed in a reaction vessel and allowed to react to form the polydiorganosiloxane oligourea segmented copolymer which can then be removed from the reaction vessel.

Optional Tackifiers

Tackifying materials for the polydiorganosiloxane polyurea copolymer, generally silicate resins, can also be added to the polymer to provide or enhance the pressure-sensitive adhesive properties of the polymer. Thus, preferred embodiments of the present invention include a pressure-sensitive adhesive component comprising one or more tackified polydiorganosiloxane polyurea copolymer. As used herein, a pressure-sensitive adhesive possesses a four-fold balance of adhesion, cohesion, stretchiness, and elasticity, and a glass transition temperature ($T_g$) of less than about 20° C. Thus, they are tacky to the touch at room temperature (e.g., about 20° C. to about 25° C.), as can be determined by a finger tack test or by conventional measurement devices, and can easily form a useful adhesive bond with the application of light pressure.

The silicate resin can play an important role in determining the physical properties of the polydiorganosiloxane polyurea copolymer of the present invention. For example, as silicate resin content is increased from low to high concentration, the glassy to rubbery transition of the polydiorganosiloxane polyurea copolymer occurs at increasingly higher temperatures. One need not be limited to a single silicate resin as it may be beneficial to employ a combination of resins in a single composition to achieve desired performance.

The silicate resins useful in the present invention include those resins composed of the following structural units M, D, T, and Q, and combinations thereof. Typical examples include MQ silicate resins, MQD silicate resins, and MQT silicate resins which also may be referred to as copolymeric silicate resins and which preferably have a number average molecular weight of about 100 to about 50,000, more preferably about 500 to about 10,000 and generally have methyl substituents. The silicate resins also include both nonfunctional and functional resins, the functional resins having one or more functionalities including, for example, silicon-bonded hydrogen, silicon-bonded alkenyl, and silanol. MQ silicate resins are copolymeric silicate resins having $R'_3SiO_{1/2}$ units and $SiO_{4/2}$ units. Such resins are described in, for example, *Encyclopedia of Polymer Science and Engineering*, vol. 15, John Wiley & Sons, New York, (1989), pp. 265–270, and U.S. Pat. Nos. 2,676,182 (Daudt et al.), 3,627,851 (Brady), 3,772,247 (Flannigan), and 5,248,739 (Schmidt et al.). MQ silicate resins having functional groups are described in U.S. Pat. No. 4,774,310 (Butler) that has silyl hydride groups, U.S. Pat. No. 5,262,558 (Kobayashi et al.) that has vinyl and trifluoropropyl groups, and U.S. Pat. No. 4,707,531 (Shirahata) that has silyl hydride and vinyl groups. The above-described resins are generally prepared in solvent. Dried, or solventless, MQ silicate resins can be prepared, as described in U.S. Pat. Nos. 5,319,040 (Wengrovius et al.), 5,302,685 (Tsumura et al.), and 4,935,484 (Wolfgruber et al.). MQD silicate resins are terpolymers having $R'_3SiO_{1/2}$ units, $SiO_{4/2}$ units, and $R'_2SiO_{2/2}$ units such as are taught in U.S. Pat. No. 2,736,721 (Dexter). MQT silicate resins are terpolymers having $R'_3SiO_{1/2}$ units, $SiO_{4/2}$ units and $R'SiO_{3/2}$ units such as are taught in U.S. Pat. No. 5,110,890 (Butler), and Japanese Kokai HE 2-36234.

Commercially available silicate resins include SR-545, MQ resin in toluene, available from General Electric Co., Silicone Resins Division, Waterford, N.Y.; MQOH resins, which are MQ resins available from PCR, Inc. Gainesville, Fla.; MQR-32-1, MQR-32-2, and MQR-32-3 which are MQD resins in toluene, available from Shin-Etsu Silicones of America, Inc., Torrance, Calif., and PC-403 a hydride functional MQ resin in toluene available from Rhone-Poulenc, Latex and Specialty Polymers, Rock Hill, S.C. Such resins are generally supplied in organic solvent and may be employed in compositions of the present invention as received. However, these organic solutions of silicate resin may also be dried by any number of techniques known in the art, such as spray drying, oven drying and the like, or steam separation to provide a silicate resin at substantially 100% nonvolatile content for use in compositions of the present invention. Also useful in polydiorganosiloxane polyurea copolymers of the present invention are blends of two or more silicate resins. In addition or in place of the silicate resins, organic tackifiers may be used.

When a tackifying material is included with the polydiorganosiloxane polyurea copolymer, that component preferably contains about 1 part to about 80 parts by weight tackifying material and more preferably about 15 parts to about 75 parts by weight tackifying material. The total parts by weight of the polydiorganosiloxane polyurea copolymer and the silicate resin in the combination equal 100. The optimum amount of tackifying material depends on such factors as the type and amount of reactants used, the molecular weight of the hard and soft segments of the polydiorganosiloxane polyurea segmented copolymer, and the intended use of the composition of the invention.

Other Optional Additives

Fillers, plasticizers, and other property modifiers, such as flow modifiers (e.g., a fuilly saturated Jojoba ester wax with a 28/60 bead size, available under the trade designation FLORABEADS from FLORATECH Americas, Gilbert, Ariz.), dyes, pigments, flame retardants, stabilizers, antioxidants, compatibilizers, antimicrobial agents, electrical conductors, and thermal conductors, may be mixed with the polydiorganosiloxane polyurea segmented organic polymer, as long as they do not interfere in the fiber-forming melt process or do not detrimentally effect the function and functionality of the final polymer product. These additives can be used in various combinations in amounts of about 0.05 weight percent to about 25 weight percent, based on the total weight of the polydiorganosiloxane polyurea composition.

Other Polymers

As discussed above, the polydiorganosiloxane polyurea copolymers of the present invention can be mixed (e.g., blended) and/or layered, for example, with other melt processable (typically, thermoplastic) polymers to tailor the properties of the fibers. Typically, the fibers of the present invention that include mixtures of such secondary melt processable polymers or copolymers with the polydiorganosiloxane polyurea copolymers. The secondary melt processable polymers or copolymers can be used in an amount of about 1 weight percent up to about 99 weight percent, based on the total weight of the polydiorganosiloxane polyurea composition. Such secondary melt processable polymers or copolymers are extrudable and capable of forming fibers. They may or may not have pressure-sensitive adhesive properties. They may or may not have any adhesive properties, either at room temperature or in the melt state. They may or may not be blended with other additives, such as tackifiers, plasticizers, antioxidants, UV stabilizers, and the like. Examples of such secondary melt processable polymers or copolymers include, but are not limited to, polyolefins such as polyethylene, polypropylene, polybutylene, polyhexene, and polyoctene; polystyrenes; polyurethanes; polyesters such as polyethyleneterephthalate; polyamides such as nylon; styrenic block copolymers of the type available under the trade designation KRATON (e.g., styrene/isoprene/styrene, styrene/butadiene/styrene); epoxies; acrylates; vinyl acetates such as ethylene vinyl acetate; and mixtures thereof A particularly preferred secondary melt processable polymer or copolymer is a tackified styrenic block copolymer. It will be understood by one of skill in the art that layered fiber constructions can be formed having alternating pressure-sensitive and nonpressure-sensitive adhesive materials or alternating pressure-sensitive adhesive materials, for example.

Preparation of Fibers and Nonwoven Webs

Melt processes for the preparation of fibers are well-known in the art. For example, such processes are disclosed in Wente, "Superfine Thermoplastic Fibers," in *Industrial Engineering Chemistry*, Vol. 48, pages 1342 et seq (1956); Report No. 4364 of the Naval Research Laboratories, published May 25, 1954, entitled "Manufacture of Superfine Organic Fibers" by Wente et al.; as well as in International Publication No. WO 96/23915, and U.S. Pat. Nos. 3,338,992 (Kinney), 3,502,763 (Hartmann), 3,692,618 (Dorschner et al.), and 4,405,297 (Appel et al.). Such processes include both spunbond processes and melt-blown processes. A preferred method for the preparation of fibers, particularly microfibers, and nonwoven webs thereof, is a melt-blown process. For example, nonwoven webs of multilayer microfibers and melt-blown processes for producing them are disclosed in U.S. Pat. Nos. 5,176,952 (Joseph et al.), 5,232,770 (Joseph), 5,238,733 (Joseph et al.), 5,258,220 (Joseph), 5,248,455 (Joseph et al.). These and other melt processes can be used in the formation of the nonwoven webs of the present invention.

Melt-blown processes are particularly preferred because they form autogenously bonded webs that typically require no further processing to bond the fibers together. The melt-blown processes used in the formation of multilayer microfibers as disclosed in the Joseph (et al.) patents listed above are particularly suitable for use in making the multilayer microfibers of the present invention. Such processes use hot (e.g., equal to or about 20° C. to about 30° C. higher than the polymer melt temperature), high-velocity air to draw out and attenuate extruded polymeric material from a die, which will generally solidify after traveling a relatively short distance from the die. The resultant fibers are termed melt-blown fibers and are generally substantially continuous. They form into a coherent web between the exit die orifice and a collecting surface by entanglement of the fibers due in part to the turbulent airstream in which the fibers are entrained.

For example, U.S. Pat. No. 5,238,733 (Joseph et al.) describes forming a multicomponent melt-blown microfiber web by feeding two separate flow streams of organic polymeric material into a separate splitter or combining manifold. The split or separated flow streams are generally combined immediately prior to the die or die orifice. The separate flow streams are preferably established into melt streams along closely parallel flow paths and combined where they are substantially parallel to each other and the flow path of the resultant combined multilayered flow stream. This multilayered flow stream is then fed into the die and/or die orifices and through the die orifices. Air slots are disposed on either side of a row of the die orifices directing uniform heated air at high velocities at the extruded multicomponent melt streams. The hot high velocity air draws and attenuates the extruded polymeric material which solidified after traveling a relatively short distance from the die. Single layer microfibers can be made in an analogous manner with air attenuation using a single extruder, no splitter, and a single port feed die.

The solidified or partially solidified fibers form an interlocking network of entangled fibers, which are collected as a web. The collecting surface can be a solid or perforated surface in the form of a flat surface or a drum, a moving belt, or the like. If a perforated surface is used, the backside of the collecting surface can be exposed to a vacuum or low-pressure region to assist in the deposition of the fibers. The collector distance is generally about 7 centimeters (cm) to about 130 cm from the die face. Moving the collector closer to the die face, e.g., about 7 cm to about 30 cm, will result in stronger inter-fiber bonding and a less lofty web.

The temperature of the separate polymer flowstreams is typically controlled to bring the polymers to substantially similar viscosities. When the separate polymer flowstreams converge, they should generally have an apparent viscosity in the melt (i.e., at melt blowing conditions) of about 150 poise to about 800 poise, as determined using a capillary rheometer. The relative viscosities of the separate polymeric flowstreams to be converged should generally be fairly well matched.

The size of the polymeric fibers formed depends to a large extent on the velocity and temperature of the attenuating airstream, the orifice diameter, the temperature of the melt stream, and the overall flow rate per orifice. Typically, fibers having a diameter of no greater than about 10 $\mu$m can be formed, although coarse fibers, e.g., up to about 50 $\mu$m or more, can be prepared using a melt-blown process, and up to about 100 $\mu$m, can be prepared using a spun bond process. The webs formed can be of any suitable thickness for the desired and intended end use. Generally, a thickness of about 0.01 cm to about 5 cm is suitable for most applications.

The polydiorganosiloxane polyurea fibers of the present invention can be mixed with other fibers, such as staple fibers, including inorganic and organic fibers, such as thermoplastic fibers, carbon fibers, glass fibers, mineral fibers, or organic binder fibers, as well as fibers of a different polydiorganosiloxane polyurea copolymer or other polymers as described herein. The polydiorganosiloxane polyurea fibers of the present invention can also be mixed with particulates, such as sorbent particulate material, fumed silica, carbon black, glass beads, glass bubbles, clay particles, metal particles, and the like. Typically, this is done prior to the fibers being collected by entraining particulates or other fibers in an airstream, which is then directed to intersect with the fiber streams. Alternatively, other polymer materials can be simultaneously melt processed with the fibers of the present invention to form webs containing more than one type of melt processed fiber, preferably, melt-blown microfiber. Webs having more than one type of fiber are referred to herein as having commingled constructions. In commingled constructions, the various types of fibers can be intimately mixed forming a substantially uniform cross-section, or they can be in separate layers. The web properties can be varied by the number of different fibers used, the number of layers employed, and the layer arrangement. Other materials, such as surfactants or binders can also be incorporated into the web before, during, or after its collection, such as by the use of a spray jet.

The nonwoven webs of the present invention can be used in composite multi-layer structures. The other layers can be supporting webs, nonwoven webs of spun bond, staple, and/or melt-blown fibers, as well as films of elastic, semipermeable, and/or impermeable materials. These other layers can be used for absorbency, surface texture, rigidification, etc. They can be attached to the nonwoven webs of the fibers of the present invention using conventional techniques such as heat bonding, binders or adhesives, or mechanical engagement such as hydroentanglement or needle punching.

Webs or composite structures including the webs of the invention can be further processed after collection or assembly, such as by calendaring or point embossing to increase web strength, provide a patterned surface, or fuse fibers at contact points in a web structure or the like; by orientation to provide increased web strength; by needle punching; heat or molding operations; coating, such as with adhesives to provide a tape structure; or the like.

The nonwoven webs of the present invention can be used to prepare adhesive articles, such as tapes, including medical grade tapes, labels, wound dressings, and the like. That is, those nonwoven webs that have adhesive properties can be used as an adhesive layer on a backing, such as paper, a polymeric film, or a conventional woven or nonwoven web, to form an adhesive article. Those that have good release properties can be used as a release layer or a low adhesion backsize layer on a backing of an adhesive article. For example, a nonwoven web of the present invention can be laminated to at least one major surface of a backing. The nonwoven web can form the pressure-sensitive adhesive layer of the adhesive article or it can form the low adhesion backsize layer of the adhesive article. A nonwoven web that has good release properties can also be laminated to a backing, such as paper, a polymeric film, or a conventional woven or nonwoven web, to form a release liner.

EXAMPLES

The following examples are provided to illustrate presently contemplated preferred embodiments, but are not intended to be limiting thereof. All percentages and parts are by weight unless otherwise noted.

Peel Adhesion Test

Peel adhesion is the force required to remove a coated flexible sheet material from a test panel measured at a specific angle and rate of removal. This force is expressed in grams per 2.54 cm width of coated sheet.

A 12.5 mm width of the coated sheet was applied to the horizontal surface of a clean glass test plate with at least 12.7 lineal centimeters (cm) in firm contact with the glass using a hard rubber roller. The free end of the coated strip was doubled back nearly touching itself so the angle of removal was 180° and attached to the adhesion tester scale. The glass test plate was clamped in the jaws of a tensile testing machine which is capable of moving the plate away from the scale at a constant rate of 2.3 meters per minute. The scale reading in grams was recorded as the tape was peeled from the glass surface.

Polydimethylsiloxane Diamine Preparation

The polydimethylsiloxane diamine was prepared generally as described in U.S. Pat. No. 5,512,650 (Leir et. al.). A mixture of 4.32 parts bis(3-aminopropyl)tetramethyl disiloxane and 95.68 parts octamethylcyclotetrasiloxane was placed in a batch reactor and purged with nitrogen for 20 minutes. The mixture was then heated in the reactor to 150° C. Catalyst, 100 ppm of 50% aqueous cesium hydroxide, was added and heating continued for 6 hours until the bis(3-aminopropyl) tetramethyl disiloxane had been consumed. The reaction mixture was cooled to 90° C. neutralized with excess acetic acid in the presence of some triethylamine, and heated under high vacuum to remove cyclic siloxanes over a period of at least five hours. The material was cooled to ambient temperature, filtered to remove any cesium acetate which had formed, and its average molecular weight determined to be approximately 5300 by titration with 1.0 N hydrochloric acid.

A mixture of 5.8 parts of the above described polydimethoxysiloxane diamine and 94.2 parts octamethylcyclotetrasiloxane was placed in a batch reactor, purged with nitrogen for 20 minutes and then heated in the reactor to 150° C. Catalyst (100 ppm of 50% aqueous cesium hydroxide) was added and the reaction mixture heated for 3 hours until equilibrium concentration of cyclic siloxanes was observed by gas chromatography. The reaction mixture was cooled to 90° C., neutralized with excess acetic acid in the presence of some triethylamine, and heated under high vacuum to remove cyclic siloxanes over a period of at least 5 hours. The material was cooled to ambient temperature, filtered to remove any cesium acetate which had formed, and its average molecular weight determined to be approximately 69,600 by titration with 1.0 N hydrochloric acid.

Tackified Polydimethylsiloxane Polyurea Preparation

A tackified polydimethylsiloxane polyurea segmented copolymer was made in the following manner. Dry MQ silicate tackifying resin (available as SR 1000 from General Electric Co., Silicone Resin Division, Waterford, N.Y.) was added at a rate of 58.3 grams/minute (g/min) into zone 1 of a Berstorff 40 millimeter (mm) diameter, 40 L/D (length to diameter ratio), co-rotating, twin screw extruder (available from Berstorff Corp., Charlotte, N.C.). The polydimethoxsiloxane diamine described above ($M_n$ of 69,600) was injected into zone 2 of the extruder at a rate of 58.3 g/min. Methylenedicyclohexylene-4,4'-diisocyanate (available as DESMODUR W from Miles Laboratories, Inc., Pittsburgh, Pa.) was injected into zone 5 of the extruder at a rate of 0.220 g/min. The fully intermeshing screws were rotating at a rate of 300 RPM, and vacuum was pulled on zone 8. The temperature profile of the extruder was: zone 1—25° C.; zone 2—45° C.; zone 3—50° C.; zone 4—45° C.; zone 5—60° C.; zone 6—120° C.; zone 7—160° C.; zones 8 through 10 and endcap 180° C.; and melt pump 190° C. The material was extruded through a strand die, quenched, collected and pelletized.

Nontacky Polydimethylsiloxane Polyurea Preparation

A nontacky (at room temperature) polydimethyl siloxane polyurea segmented copolymer was prepared by feeding the 5300 MW diamine described above at a rate of 76.1 grams/minute (g/min) into zone 2 of a 40 mm diameter, 1600 mm long (i.e., a 40 length to diameter (L/D) ratio), co-rotating twin screw Berstortf extruder. The extruder was fitted with fully self-wiping double-start screws. Tetramethyl-m-xylylene diisocyanate (available from Cytec Industries, Inc., West Patterson, N.J.) was fed into zone 8 of the extruder at a rate of 3.97 g/min (0.0163 mol/min) with the feed line brushing the screws. The extruder screw speed was 100 revolutions per miute and the temperature profile for each of the 160 mm zones was: zone 1—27° C.; zones 2 through 8—60° C.; zone 9—120° C.; zone 10—175° C.; and endcap—180° C. The resultant polymer was extruded into a 3 mm diameter strand, cooled in a water bath, pelletized, and, collected.

Example 1

A reactively extruded polydimethylsiloxane polyurea based PSA web was prepared using a melt blowing process similar to that described, for example, in Wente, Van A., "Superfine Thermoplastic Fibers," in *Industrial Engineering Chemistry*, Vol. 48, pages 1342 et seq. (1956) or in Report No. 4364 of the Naval Research Laboratories, published May 25, 1954, entitled "Manufacture of Superfine Organic Fibers" by Wente, Van A.; Boone, C. D.; and Fluharty, E. L., except that the apparatus was connected to a melt-blowing die having circular smooth surfaces orifices (10/cm) with a 5:1 length to diameter ratio. The feedblock assembly immediately preceding the melt blowing die, which was maintained at 230° C., was fed by a tackified polydimethylsiloxane polyurea/KRATON based PSA composition consisting of 75 percent by weight of the tackified polydimethyl siloxane polyurea described above, and 25 percent by weight of a KRATON based PSA composition consisting of 100 parts per hundred parts elastomer (phr) KRATON D1112 (a styrene/isoprene/styrene block copolymer available from Shell Chemical Company, Houston, Tex.), 100 phr ESCOREZ 1310LC tackifier (a $C_5/C_6$ hydrocarbon available from Exxon Chemical Co., Houston, Tex.), 4 phr IRGANOX 1076 antioxidant (available from CIBA-GEIGY Corp., Hawthorne, N.Y.), and 4 phr TINUVIN 328 UV stabilizer (available from CIBA-GEIGY Corp.), at a temperature of 230° C.

A gear pump intermediate of the extruder and the feedblock assembly was adjusted to deliver the polydimethylsiloxane polyurea/KRATON melt stream to the die, which was maintained at 230° C., at a rate of 178 grams/hour/centimeter (g/hr/cm) die width. The primary air was maintained at 206° C. and 138 kilopascals (KPa) with a 0.076 centimeter (cm) gap width, to produce a uniform web. The fibers were collected on a 1.5 mil (37 μm) thick poly (ethylene terephthalate) film (PET) which passed around a rotating drum collector at a collector to die distance of 20.3 cm. The resulting web, comprising PSA microfibers of a blend of polydimethyl siloxane polyurea and KRATON polymers having an average diameter of less than about 25 μm, had a basis weight of 50 grams/square meter (g/m$^2$) and exhibited a peel strength to glass of 420 g/2.54 cm at a peel rate of 30.5 cm/minute, 726 g/2.54 cm at a peel rate of 228 cm/minute.

Example 2

A polydimethyl siloxane urea based PSA web was prepared essentially as described in EXAMPLE 1 except that the tackified polydimethyl siloxane polyurea/KRATON based PSA composition was replaced with a tackified polydimethyl siloxane polyurea segmented copolymer/Jojoba ester composition consisting of 92 parts by weight of the tackified polydimethyl siloxane polyurea segmented copolymer described above, and 8 parts by weight of FLORABEADS (28/60 bead size, a fully saturated Jojoba ester flow modifier, CAS #159518-85-1, available from FLORATECH Americas, Gilbert, Ariz.). The die was maintained at a temperature of 230° C. and the primary air was maintained at 225° C. and 172 KPa with a 0.076 cm gap width. The thus produced PSA web, which was collected on a 1.5 mil (37 μm) PET film, had a basis weight of 40 g/m$^2$ and exhibited a peel strength to glass of 675 g/2.54 cm at a peel rate of 30.5 centimeters/minute (cm/min), 855 g/2.54 cm at a peel rate of 228 cm/min.

Example 3

A PSA web was prepared essentially as described in EXAMPLE 1 except that the apparatus utilized two extruders, each of which was connected to a gear pump which was, in turn, connected to a 3-layer feedblock splitter assembly similar to that described in U.S. Pat. Nos. 3,480,502 (Chisholm et. al.) and 3,487,505 (Schrenk). One of the extruders supplied a KRATON based PSA composition consisting of 100 phr KRATON D1112 (a styrene/isoprene/styrene block copolymer available from Shell Chemical Company), 100 phr WINGTACK Plus tackifier (an aromatically modified $C_5$, petroleum hydrocarbon resin, available from Goodyear Tire and Chemical Co., Akron, Ohio), 4 phr IRGANOX 1076 antioxidant, and 4 phr TINUVIN 328 UV stabilizer at 190° C. to the feedblock, which was maintained at 230° C. The second extruder supplied the tackified polydimethyl siloxane polyurea segmented copolymer described above at 230° C. to the feedblock. The feedblock split the tackified polydimethyl siloxane polyurea segmented copolymer melt stream and recombined it in an alternating manner with the KRATON D1112 based PSA melt stream into a 3 layer melt stream exiting the feedblock, the two outermost layers of the exiting stream being the tackified polydimethyl siloxane polyurea segmented copolymer formulation. The gear pumps were adjusted so that a 47.5/52.5 melt volume ratio of the tackified polydimethyl siloxane polyurea/KRATON D1112 based PSA melt stream was delivered to the die. The die was maintained at a temperature of 230° C. and the primary air was maintained at 230° C. and 172 KPa with a 0.076 cm gap width. The resulting PSA web, comprising 3-layer microfibers having an average diameter of less than about 25 μm, had a basis weight of 57 g/m$^2$ and exhibited good qualitative adhesive properties to glass and polypropylene substrates.

Example 4

A PSA web was prepared essentially as described in EXAMPLE 3 except that 3-layer feedblock splitter was replaced with a 5-layer feedblock splitter assembly similar to that described in U.S. Pat. Nos. 3,480,502 (Chisholm et. al.) and 3,487,505 (Schrenk), the KRATON D1112 based PSA formulation was replaced with a second KRATON D1107 based PSA formulation consisting of 100 phr KRATON D1107 (a styrene/isoprene/styrene block copolymer available from Shell Chemical Company), 80 phr ESCOREZ 1310 LC (an aliphatic hydrocarbon ($C_5$/$C_6$) tackifier available from Exxon Chemicals Co., Houston, Tex.), 10 phr ZONAREZ A25 (an alpha-pinene type resin available from Arizona Chemical, Panama City, Fla.), 4 phr IRGANOX 1076 antioxidant, and 4 phr TINUVIN 328 UV stabilizer. The feedblock was maintained at 230° C., the die was maintained at a temperature of 230° C., the primary air was maintained at 230° C. and 172 KPa with a 0.076 cm gap width, and the gear pumps were adjusted so that a 25/75 melt volume ratio of the tackified polydimethyl siloxane polyurea/KRATON D1107 based PSA was delivered to the die. The resulting PSA web comprising 5-layer microfibers had a basis weight of 54 g/m$^2$ and exhibited good qualitative adhesive properties to glass and polypropylene substrates.

Example 5

A five-layer fiber PSA web was prepared essentially as described in EXAMPLE 4 except that the gear pumps were adjusted so that a 10/90 melt volume ratio of the tackified polydimethyl siloxane polyurea/KRATON D1107 based PSA was delivered to the die. The resulting PSA web had a basis weight of 54 g/m$^2$ and exhibited good qualitative adhesive properties to glass and polypropylene substrates.

Example 6

A single component fiber nonwoven web based on the nontacky (at room temperature) polydimethyl siloxane polyurea described above was prepared essentially as described in EXAMPLE 1 except that the tackified polydimethyl siloxane polyurea/KRATON based PSA composition was replaced with the nontacky (at room temperature) polydimethyl siloxane polyurea, which was delivered to the die at a temperature of 170° C. The die was maintained at a temperature of 170° C. and the primary air was maintained at 170° C. and 103 KPa with a 0.076 cm gap width. The thus produced nonwoven web, which was collected on a 1.5 mil (37 μm) biaxially oriented polypropylene (BOPP) film, had a basis weight of 25 g/m$^2$ and exhibited no adhesion to itself, glass or polypropylene substrates.

Example 7

A three-layer fiber PSA web was prepared essentially as described in EXAMPLE 3 except one extruder supplied a melt stream of the nontacky (at room temperature) polydimethyl siloxane polyurea segmented copolymer of EXAMPLE 6 at a melt temperature of 190° C. and the second extruder supplied a polyethylene melt stream (PE 6806, available from Dow Chemical Company, Freeport, Tex.) at a temperature of 190° C. The feedblock assembly was maintained at a temperature of 190° C. and the primary air was maintained at 190° C. and 103 KPa, and the gear pumps were adjusted so that a 75/25 melt volume ratio of the nontacky (at room temperature) polydimethyl siloxane polyurea/polyethylene was delivered to the die. The nonwoven web, comprising three layer blown microfibers having an average diameter of less than about 25 μm with the nontacky (at room temperature) polydimethyl siloxane polyurea segmented copolymer present as the outer layers on the microfibers, was collected on a BOPP film at a collector to die distance of 25.4 cm. The nonwoven web had a basis weight of 25 g/m$^2$ and exhibited no adhesion to itself, glass or polypropylene substrates.

Example 8

A three-layer fiber PSA web was prepared essentially as described in EXAMPLE 7 except that the second extruder supplied a melt stream comprising a KRATON based PSA composition containing 100 phr KRATON D1112 (a styrene/isoprene/styrene block copolymer available from Shell Chemical Company, Houston, Tex.) and 100 phr ESCOREZ 1310 LC tackifier, 4 phr IRGANOX 1076 antioxidant, and 4 phr TINUVIN 328 UV stabilizer at a temperature of 170° C. The feedblock assembly was maintained at a temperature of 190° C. and the primary air was maintained at 190° C. and 103 KPa, and the gear pumps were adjusted so that a 25/75 melt volume ratio of the nontacky (at room temperature) polydimethyl siloxane polyurea/polyethylene was delivered to the die. The resulting nonwoven web, which was collected on a BOPP film at a collector to die distance of 25.4 cm, had a basis weight of 25 g/m$^2$, and exhibited a peel strength to glass of 116.4 g/2.54 cm at a peel rate of 30.5 cm/min, and 230 g/2.54 cm at a peel rate of 228 cm/min.

Example 9

A three-layer fiber PSA web was prepared essentially as described in EXAMPLE 8 except that the gear pumps were adjusted so that a 50/50 melt volume ratio of the nontacky (at room temperature) polydimethylsiloxane polyurea/KRATON based PSA was delivered to the die. The resulting nonwoven web had a basis weight of 25 g/m$^2$, and exhibited a peel strength to glass of 36.9 g/2.54 cm at a peel rate of 30.5 cm/min, and 28.4 g/2.54 cm at a peel rate of 228 cm/min.

Example 10

A three-layer fiber PSA web was prepared essentially as described in EXAMPLE 8 except that the gear pumps were adjusted so that a 75/25 melt volume ratio of the nontacky (at room temperature) polydimethylsiloxane polyurea/KRATON based PSA was delivered to the die. The resulting nonwoven web had a basis weight of 25 g/m$^2$, and exhibited a peel strength to glass of 17 g/2.54 cm at a peel rate of 30.5 cm/min, and 45.4 g/2.54 cm at a peel rate of 228 cm/min.

All patents, patent applications, and publications cited herein are each incorporated by reference, as if individually incorporated. The various modifications and alterations of this invention will be apparent to those skilled in the art without departing from the scope and spirit of this invention. This invention should not be restricted to that set forth herein for illustrative purposes.

What is claimed is:

1. A fiber having a diameter of no greater than about 100 μm comprising a polydiorganosiloxane polyurea copolymer as a structural component of the fiber.

2. The fiber of claim 1 which is in the form of a multilayer fiber comprising at least a first layer comprising a polydiorganosiloxane polyurea copolymer.

3. The fiber of claim 2 further comprising at least a second layer comprising a secondary melt processable polymer or copolymer.

4. The fiber of claim 3 wherein the secondary melt processable polymer or copolymer is selected from the group consisting of a polyolefin, a polystyrene, a polyurethane, a polyester, a polyamide, a styrenic block copolymer, an epoxy, a vinyl acetate, and mixtures thereof.

5. The fiber of claim 4 wherein the secondary melt processable polymer or copolymer is a tackified styrenic block copolymer.

6. The fiber of claim 3 wherein the secondary melt processable polymer or copolymer is mixed with a tackifier.

7. The fiber of claim 1 wherein the polydiorganosiloxane polyurea copolymer is a polydiorganosiloxane oligourea copolymer.

8. The fiber of claim 1 further comprising at least one secondary melt processable polymer or copolymer mixed with the polydiorganosiloxane polyurea copolymer.

9. The fiber of claim 8 wherein the secondary melt processable polymer or copolymer is selected from the group consisting of a polyolefin, a polystyrene, a polyurethane, a polyester, a polyamide, a styrenic block copolymer, an epoxy, a vinyl acetate, and mixtures thereof.

10. The fiber of claim 9 wherein the secondary melt processable polymer or copolymer is a tackified styrenic block copolymer.

11. The fiber of claim 1 further comprising a tackifier mixed with the polydiorganosiloxane polyurea copolymer.

12. The fiber of claim 11 wherein the tackifier is a silicate resin.

13. The fiber of claim 1 wherein the polydiorganosiloxane polyurea copolymer has an apparent viscosity in the melt in a range of about 150 poise to about 800 poise.

14. The fiber of claim 1 wherein the polydiorganosiloxane polyurea copolymer is the reaction product of at least one polyisocyanate with at least one polyamine; wherein the polyamine comprises at least one polydiorganosiloxane diamine, or a mixture of at least one polydiorganosiloxane diamine and at least one organic amine.

15. The fiber of claim 14 wherein the mole ratio of isocyanate to amine is in a range of about 0.9:1 to about 1.3:1.

16. The fiber of claim 1 wherein the polydiorganosiloxane polyurea copolymer is represented by the repeating unit:

(I)

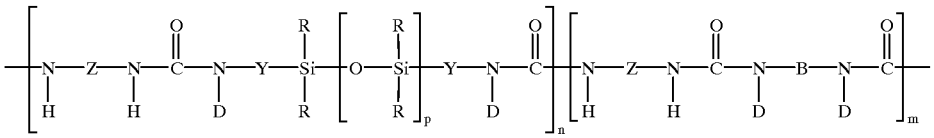

wherein:

each R is a moiety that independently is:

an alkyl moiety having 1 to 12 carbon atoms optionally substituted with trifluoroalkyl or vinyl groups;

a vinyl moiety or higher alkenyl moiety represented by the formula $—R^2(CH_2)_aCH{=}CH_2$ wherein $R^2$ is $—(CH_2)_b—$ or $—(CH_2)_cCH{=}CH—$ and a is 1, 2, or 3, is 0, 3, or 6, and c is 3, 4, or 5;

a cycloalkyl moiety having 6 to 12 carbon atoms optionally substituted with alkyl, fluoroalkyl, and vinyl groups;

an aryl moiety having 6 to 20 carbon atoms optionally substituted with alkyl, cycloalkyl, fluoroalkyl and vinyl groups;

a perfluoroalkyl group;

a fluorine-containing group; or a perfluoroether-containing group;

each Z is a polyvalent moiety that is an arylene moiety or an aralkylene moiety having 6 to 20 carbon atoms, or an alkylene or cycloalkylene moiety having 6 to 20 carbon atoms;

each Y is a polyvalent moiety that independently is an alkylene moiety having 1 to 10 carbon atoms, or an aralkylene moiety or an arylene moiety having 6 to 20 carbon atoms;

each D is independently selected from the group of hydrogen, an alkyl moiety of 1 to 10 carbon atoms, phenyl, and a moiety that completes a ring structure including B or Y to form a heterocycle;

B is a polyvalent moiety selected from the group of alkylene, aralkylene, cycloalkylene, phenylene, polyalkylene oxide, copolymers and mixtures thereof;

m is a number that is 0 to about 1000;

n is a number that is equal to or greater than 1; and p is a number that is about 5 or larger.

17. The fiber of claim 1 wherein the polydiorganosiloxane polyurea copolymer is a polydiorganosiloxane oligourea segmented copolymer represented by Formula II:

wherein:

each R is a moiety that independently is:

an alkyl moiety having 1 to 12 carbon atoms optionally substituted with trifluoroalkyl or vinyl groups;

a vinyl moiety or higher alkenyl moiety represented by the formula $—R^2(CH_2)_aCH{=}CH_2$ wherein $R^2$ is $—(CH_2)_b—$ or $—(CH_2)_cCH{=}CH—$ and a is 1, 2, or 3, b is 0, 3, or 6, and c is 3, 4, or 5;

a cycloalkyl moiety having 6 to 12 carbon atoms optionally substituted with alkyl, fluoroalkyl, and vinyl groups;

an aryl moiety having 6 to 20 carbon atoms optionally substituted with alkyl, cycloalkyl, fluoroalkyl and vinyl groups;

a perfluoroalkyl group;

a fluorine-containing group; or a perfluoroether-containing group;

each Z is a polyvalent moiety that is an arylene moiety or an aralkylene moiety having 6 to 20 carbon atoms, or an alkylene or cycloalkylene moiety having 6 to 20 carbon atoms;

each Y is a polyvalent moiety that independently is an alkylene moiety having 1 to 10 carbon atoms, or an aralkylene moiety or an arylene moiety having 6 to 20 carbon atoms;

each D is independently selected from the group of hydrogen, an alkyl moiety of 1 to 10 carbon atoms, phenyl, and a moiety that completes a ring structure including Y to form a heterocycle;

each X is a monovalent moiety which is not reactive under moisture curing or free radical curing conditions and which independently is an alkyl moiety having about 1 to 12 carbon atoms;

q is a number that is about 5 to about 2000;

r is a number that is about 1 to about 2000; and t is a number that is up to about 8.

18. The fiber of claim 16 which is in the form of a multilayer fiber comprising at least a first layer comprising a polydiorganosiloxane polyurea copolymer of Formula 1 wherein n is greater than 8.

19. The fiber of claim 18 further comprising at least a second layer comprising a polydiorganosiloxane oligourea segmented copolymer represented by Formula II:

(II)

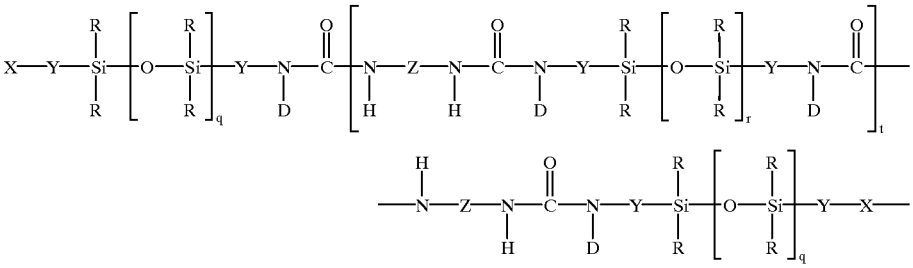

(II)

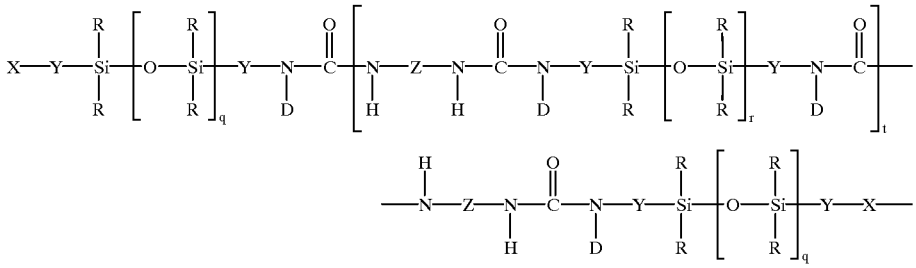

wherein:

each R is a moiety that independently is:

an alkyl moiety having 1 to 12 carbon atoms optionally substituted with trifluoroalkyl or vinyl groups;

a vinyl moiety or higher alkenyl moiety represented by the formula $—R^2(CH_2)_aCH{=}CH_2$ wherein $R^2$ is $—(CH_2)_b—$ or $—(CH_2)_cCH{=}CH—$ and a is 1, 2, or 3, b is 0, 3, or 6, and c is 3, 4, or 5;

a cycloalkyl moiety having 6 to 12 carbon atoms optionally substituted with alkyl, fluoroalkyl, or vinyl groups;

an aryl moiety having 6 to 20 carbon atoms optionally substituted with alkyl, cycloalkyl, fluoroalkyl or vinyl groups;

a perfluoroalkyl group;

a fluorine-containing group; or a perfluoroether-containing group;

each Z is a polyvalent moiety that is an arylene moiety or an aralkylene moiety having 6 to 20 carbon atoms, or an alkylene or cycloalkylene moiety having 6 to 20 carbon atoms;

each Y is a polyvalent moiety that independently is an alkylene moiety having 1 to 10 carbon atoms, or an aralkylene moiety or an arylene moiety having 6 to 20 carbon atoms;

each D is independently selected from the group consisting of hydrogen, an alkyl moiety of 1 to 10 carbon atoms, phenyl, and a moiety that completes a ring structure including Y to form a heterocycle;

each X is a monovalent moiety which is not reactive under moisture curing or free radical curing conditions and which independently is an alkyl moiety having about 1 to 12 carbon atoms;

q is a number that is about 5 to about 2000;

r is a number that is about 1 to about 2000; and t is a number that is up to about 8.

20. A nonwoven web comprising fibers having a diameter of no greater than about 100 $\mu$m comprising a polydiorganosiloxane polyurea copolymer as a structural component of the fibers.

21. The nonwoven web of claim 20 wherein each fiber is in the form of a multilayer fiber comprising at least a first layer comprising a polydiorganosiloxane polyurea copolymer.

22. The nonwoven web of claim 21 wherein each fiber further comprises at least a second layer comprising a secondary melt processable polymer or copolymer.

23. The nonwoven web of claim 22 wherein the secondary melt processable polymer or copolymer is selected from the group of a polyolefin, a polystyrene, a polyurethane, a polyester, a polyamide, a styrenic block copolymer, an epoxy, a vinyl acetate, and mixtures thereof.

24. The nonwoven web of claim 23 wherein the secondary melt processable polymer or copolymer is a tackified styrenic block copolymer.

25. The nonwoven web of claim 22 wherein the second layer of each fiber further comprises a tackifier.

26. The nonwoven web of claim 20 wherein the polydiorganosiloxane polyurea copolymer is a polydiorganosiloxane oligourea copolymer.

27. The nonwoven web of claim 20 wherein the fibers further comprise at least one secondary melt processable polymer or copolymer mixed with the polydiorganosiloxane polyurea copolymer.

28. The nonwoven web of claim 27 wherein the secondary melt processable polymer or copolymer is selected from the group consisting of a polyolefin, a polystyrene, a polyurethane, a polyester, a polyamide, a styrenic block copolymer, an epoxy, a vinyl acetate, and mixtures thereof.

29. The nonwoven web of claim 28 wherein the secondary melt processable polymer or copolymer is a tackified styrenic block copolymer.

30. The nonwoven web of claim 20 wherein the fibers further comprise a tackifier mixed with the polydiorganosiloxane polyurea copolymer.

31. The nonwoven web of claim 30 wherein the tackifier is a silicate resin.

32. The nonwoven web of claim 20 wherein the polydiorganosiloxane polyurea copolymer has an apparent viscosity in the melt in a range of about 150 poise to about 800 poise.

33. The nonwoven web of claim 20 wherein the polydiorganosiloxane polyurea copolymer is the reaction product of at least one polyisocyanate with at least one polyamine; wherein the polyamine comprises at least one polydiorganosiloxane diamine, or a mixture of at least one polydiorganosiloxane diamine and at least one organic amine.

34. The nonwoven web of claim 33 wherein the mole ratio of isocyanate to amine is in a range of about 0.9:1 to about 1.3:1.

35. The nonwoven web of claim 20 wherein the polydiorganosiloxane polyurea copolymer is represented by the repeating unit:

(I)

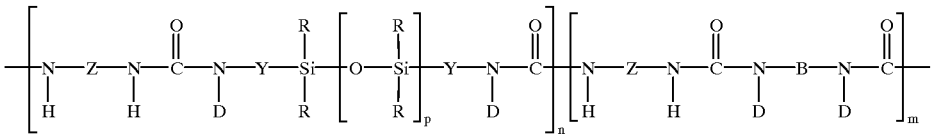

wherein:

each R is a moiety that independently is:

an alkyl moiety having 1 to 12 carbon atoms optionally substituted with trifluoroalkyl or vinyl groups;

a vinyl moiety or higher alkenyl moiety represented by the formula $—R^2(CH_2)_aCH{=}CH_2$ wherein $R^2$ is $—(CH_2)_b—$ or $—(CH_2)_cCH{=}CH—$ and a is 1, 2, or 3, b is 0, 3, or 6, and c is 3, 4, or 5;

a cycloalkyl moiety having 6 to 12 carbon atoms optionally substituted with alkyl, fluoroalkyl, or vinyl groups;

an aryl moiety having 6 to 20 carbon atoms optionally substituted with alkyl, cycloalkyl, fluoroalkyl or vinyl groups;

a perfluoroalkyl group;

a fluorine-containing group; or a perfluoroether-containing group;

each Z is a polyvalent moiety that is an arylene moiety or an aralkylene moiety having 6 to 20 carbon atoms, or an alkylene or cycloalkylene moiety having 6 to 20 carbon atoms;

each Y is a polyvalent moiety that independently is an alkylene moiety having 1 to 10 carbon atoms, or an aralkylene moiety or an arylene moiety having 6 to 20 carbon atoms;

each D is independently selected from the group consisting of hydrogen, an alkyl moiety of 1 to 10 carbon atoms, phenyl, and a moiety that completes a ring structure including B or Y to form a heterocycle;

B is a polyvalent moiety selected from the group consisting of alkylene, aralkylene, cycloalkylene, phenylene, polyalkylene oxide, copolymers and mixtures thereof, m is a number that is 0 to about 1000;

n is a number that is equal to or greater than 1; and p is a number that is about 5 or larger.

36. The nonwoven web of claim 20 wherein the polydiorganosiloxane polyurea copolymer is a polydiorganosiloxane oligourea segmented copolymer represented by Formula II:

wherein:

each R is a moiety that independently is:

an alkyl moiety having 1 to 12 carbon atoms optionally substituted with trifluoroalkyl or vinyl groups;

a vinyl moiety or higher alkenyl moiety represented by the formula $—R^2(CH_2)_aCH{=}CH_2$ wherein $R^2$ is $—(CH_2)_b—$ or $—(CH_2)_cCH{=}CH—$ and a is 1, 2, or 3, b is 0, 3, or 6, and c is 3, 4, or 5;

a cycloalkyl moiety having 6 to 12 carbon atoms optionally substituted with alkyl, fluoroalkyl, or vinyl groups;

an aryl moiety having 6 to 20 carbon atoms optionally substituted with alkyl, cycloalkyl, fluoroalkyl or vinyl groups;

a perfluoroalkyl group;

a fluorine-containing group; or a perfluoroether-containing group;

each Z is a polyvalent moiety that is an arylene moiety or an aralkylene moiety having 6 to 20 carbon atoms, or an alkylene or cycloalkylene moiety having 6 to 20 carbon atoms;

each Y is a polyvalent moiety that independently is an alkylene moiety having 1 to 10 carbon atoms, or an aralkylene moiety or an arylene moiety having 6 to 20 carbon atoms;

each D is independently selected from the group consisting of hydrogen, an alkyl moiety of 1 to 10 carbon atoms, phenyl, and a moiety that completes a ring structure including Y to form a heterocycle;

each X is a monovalent moiety which is not reactive under moisture curing or free radical curing conditions and which independently is an alkyl moiety having about 1 to 12 carbon atoms;

q is a number that is about 5 to about 2000;

r is a number that is about 1 to about 2000; and t is a number that is up to about 8.

37. The nonwoven web of claim 35 wherein each fiber is in the form of a multilayer fiber comprising at least a first layer comprising a polydiorganosiloxane polyurea copolymer of Formula I wherein n is greater than 8.

38. The nonwoven web of claim 37 further comprising at least a second layer comprising a polydiorganosiloxane oligourea segmented copolymer represented by Formula II:

(II)

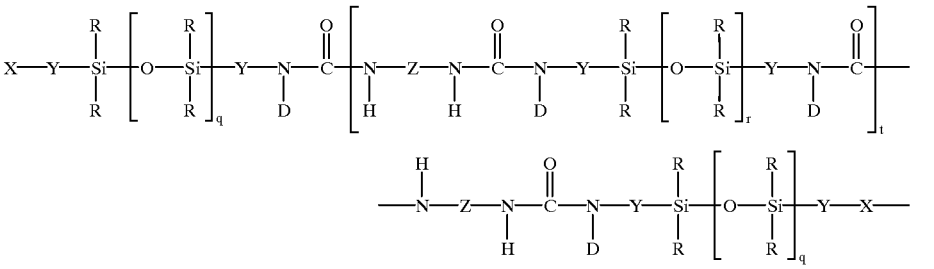

(II)

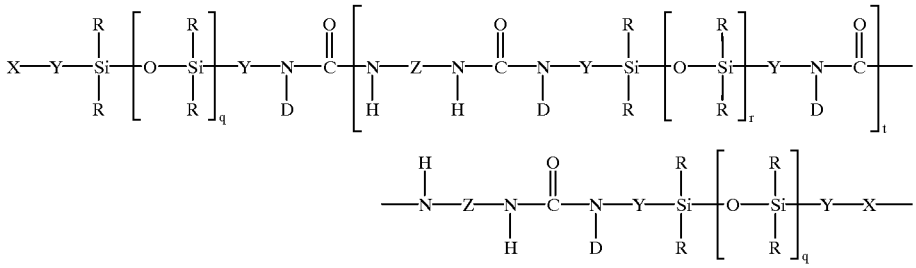

wherein:

each R is a moiety that independently is:

an alkyl moiety having 1 to 12 carbon atoms optionally substituted with trifluoroalkyl or vinyl groups;

a vinyl moiety or higher alkenyl moiety represented by the formula $—R^2(CH_2)_aCH{=}CH_2$ wherein $R^2$ is $—(CH_2)_b—$ or $—(CH_2)_cCH{=}CH—$ and a is 1, 2, or 3, b is 0, 3, or 6, and c is 3, 4, or 5;

a cycloalkyl moiety having 6 to 12 carbon atoms optionally substituted with alkyl, fluoroalkyl, or vinyl groups;

an aryl moiety having 6 to 20 carbon atoms optionally substituted with alkyl, cycloalkyl, fluoroalkyl or vinyl groups;

a perfluoroalkyl group;

a fluorine-containing group; or a perfluoroether-containing group;

each Z is a polyvalent moiety that is an arylene moiety or an aralkylene moiety having 6 to 20 carbon atoms, or an alkylene or cycloalkylene moiety having 6 to 20 carbon atoms;

each Y is a polyvalent moiety that independently is an alkylene moiety having 1 to 10 carbon atoms, or an aralkylene moiety or an arylene moiety having 6 to 20 carbon atoms;

each D is independently selected from the group consisting of hydrogen, an alkyl moiety of 1 to 10 carbon atoms, phenyl, and a moiety that completes a ring structure including Y to form a heterocycle;

each X is a monovalent moiety which is not reactive under moisture curing or free radical curing conditions and which independently is an alkyl moiety having about 1 to 12 carbon atoms;

q is a number that is about 5 to about 2000;

r is a number that is about 1 to about 2000; and t is a number that is up to about 8.

39. The nonwoven web of claim 20 which is in the form of a commingled web further comprising fibers comprising a secondary melt processable polymer or copolymer.

40. The nonwoven web of claim 20 further comprising fibers selected from the group consisting of thermoplastic fibers, carbon fibers, glass fibers, mineral fibers, organic binder fibers, and mixtures thereof.

41. The nonwoven web of claim 20 further comprising particulate material.

42. An adhesive article comprising a backing and a layer of a nonwoven web laminated to at least one major surface of the backing; wherein the nonwoven web comprises fibers having a diameter of no greater than about 100 μm comprising a polydiorganosiloxane polyurea copolymer as a structural component of the fibers.

43. The adhesive article of claim 42 wherein the nonwoven web forms a pressure-sensitive adhesive layer.

44. The adhesive article of claim 43 wherein the nonwoven web forms a low adhesion backsize layer.

45. The adhesive article of claim 42 wherein the nonwoven web forms a low adhesion backsize layer.

46. A release liner comprising a backing and a layer of a nonwoven web laminated to at least one major surface of the backing; wherein the nonwoven web comprises fibers having a diameter of no greater than about 100 μm comprising a polydiorganosiloxane polyurea copolymer as a structural component of the fibers.

47. The fiber of claim 1 having a diameter of no greater than about 50 μm.

48. The fiber of claim 47 having a diameter of no greater than about 25 μm.

49. The nonwoven web of claim 20 wherein the fibers have a diameter of no greater than about 50 μm.

50. The nonwoven web of claim 49 wherein the fibers have a diameter of no greater than about 25 μm.

51. The adhesive article of claim 42 wherein the fibers of the nonwoven web have a diameter of no greater than about 50 μm.

52. The adhesive article of claim 51 wherein the fibers of the nonwoven web have a diameter of no greater than about 25 μm.

53. The release liner of claim 46 wherein the fibers of the nonwoven web have a diameter of no greater than about 50 μm.

54. The release liner of claim 53 wherein the fibers of the nonwoven web have a diameter of no greater than about 25 μm.

55. The adhesive article of claim 42 wherein each fiber of the nonwoven web is in the form of a multilayer fiber comprising at least a first layer comprising a polydiorganosiloxane polyurea copolymer.

56. The adhesive article of claim 55 wherein each fiber of the nonwoven web further comprises at least a second layer comprising a secondary melt processable polymer or copolymer.

* * * * *